US007572102B1

(12) United States Patent
Liang

(10) Patent No.: US 7,572,102 B1
(45) Date of Patent: Aug. 11, 2009

(54) LARGE TAPERED AIR COOLED TURBINE BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 478 days.

(21) Appl. No.: 11/524,017

(22) Filed: Sep. 20, 2006

(51) Int. Cl.
*F01D 5/08* (2006.01)

(52) U.S. Cl. ..... 416/1; 415/115; 416/92; 416/97 R

(58) Field of Classification Search ..... 415/115; 416/1, 92, 97 R
See application file for complete search history.

(56) References Cited

U.S. PATENT DOCUMENTS

| | | | | | |
|---|---|---|---|---|---|
| 4,462,754 | A | | 7/1984 | Schofield | |
| 4,500,258 | A | * | 2/1985 | Dodd et al. | 416/97 R |
| 4,992,026 | A | * | 2/1991 | Ohtomo et al. | 416/97 R |
| 5,403,159 | A | * | 4/1995 | Green et al. | 416/97 R |
| 5,462,405 | A | | 10/1995 | Hoff et al. | |
| 5,498,132 | A | | 3/1996 | Carozza et al. | |
| 5,599,166 | A | | 2/1997 | Deptowicz et al. | |
| 5,779,447 | A | | 7/1998 | Tomita et al. | |
| 5,902,093 | A | | 5/1999 | Liotta et al. | |
| 5,997,251 | A | * | 12/1999 | Lee | 416/97 R |
| 6,126,396 | A | | 10/2000 | Doughty et al. | |
| 6,139,269 | A | * | 10/2000 | Liang | 416/97 R |
| 6,152,695 | A | | 11/2000 | Fukue et al. | |
| 6,164,913 | A | | 12/2000 | Reddy | |
| 6,402,471 | B1 | | 6/2002 | Demers et al. | |
| 6,471,480 | B1 | | 10/2002 | Balkcum, III et al. | |
| 6,634,858 | B2 | | 10/2003 | Roeloffs et al. | |
| 6,811,378 | B2 | | 11/2004 | Kraft | |
| 6,910,864 | B2 | | 6/2005 | Tmberg | |
| 6,923,623 | B2 | | 8/2005 | Cleveland et al. | |
| 6,929,451 | B2 | | 8/2005 | Gregg et al. | |
| 6,932,573 | B2 | * | 8/2005 | Liang | 416/97 R |
| 6,974,308 | B2 | * | 12/2005 | Halfmann et al. | 416/97 R |
| 6,997,679 | B2 | | 2/2006 | Beddard et al. | |
| 7,104,757 | B2 | * | 9/2006 | Gross | 416/97 R |
| 7,118,337 | B2 | * | 10/2006 | Liang | 416/97 R |
| 7,296,972 | B2 | * | 11/2007 | Liang | 416/97 R |

* cited by examiner

*Primary Examiner*—Igor Kershteyn
(74) *Attorney, Agent, or Firm*—John Ryznic

(57) ABSTRACT

A large tapered air cooled turbine blade having a serpentine flow cooling circuit with a first leg located adjacent to a leading edge of the blade and a third leg at the trailing edge, where the third leg includes an impingement cooling channel formed along the upper span of the blade on the trailing edge. The impingement cooling cavity includes impingement holes connected to the third leg of the serpentine flow circuit to provide cooling air into the impingement cavity, which is then discharged through exit cooling holes spaced along the upper span of the trailing edge of the blade. A separate cooling channel is formed along the lower span of the trailing edge and includes exit cooling holes to discharge cooling air through the lower span trailing edge. The upper span impingement cavity is supplied with separate cooling air from the lower span cooling cavity. The blade is formed from cores in which the trailing edge portion of the blade is formed from a first core member that forms the last leg of the serpentine flow circuit and the impingement cavity of the upper span, and a second core member that forms the lower span cooling circuit. The first core member includes a core tie with a print out hole in which a print out on the second core is inserted to form a core assembly used to form the trailing edge cooling circuit.

20 Claims, 2 Drawing Sheets

LARGE TAPERED AIR COOLED TURBINE BLADE

BACKGROUND OF THE INVENTION

1. Field of the Invention

The present invention relates generally to fluid reaction surfaces, and more specifically to an air cooled large turbine blade.

2. Description of the Related Art Including Information Disclosed Under 37 CFR 1.97 and 1.98

A gas turbine engine includes a turbine section in which a hot gas flow passes through and reacts against a plurality of stages of stationary guide vanes and rotary blades to drive a rotor shaft. The engine efficiency can be increased by providing for a higher temperature flow through the turbine. Modern blade and vane materials limit the temperature that can be used without damaging the airfoils. In order to increase the efficiency, some of the stages of vanes and blades are cooled by passing cooling air through the internal airfoils. This will allow for a higher operating temperature without damaging the airfoils. Complex cooling circuits have been proposed in the Prior Art to maximize the use of cooling air, since the cooling air is bled off from the compressor which also decreases the efficiency of the engine.

In large turbines such as an industrial gas turbine engine, the third stage rotor blade is very large, especially compared to aero engines. If cooling of the third stage rotor blade is required, cooling passages must be cast into the blade or drilled after casting.

Prior Art cooling of a large turbine rotor is achieved by drilling radial holes into the blade from blade tip and root sections. Limitations of drilling a long radial hole from both ends of the airfoil increases for a large highly twisted and tapered blade airfoil that are used in industrial gas turbine (IGT) engines. Reduction of the available airfoil cross sectional area for drilling radial holes is a function of the blade twist and taper. Higher airfoil twist and taper yield a lower available cross sectional area for drilling radial cooling holes. Cooling of the large, highly twisted and tapered blade by the prior art manufacturing technique will not achieve the optimum blade cooling effectiveness. Especially lacking cooling for the airfoil leading and trailing edges. This prevents high firing temperature applications as well as low cooling flow design. U.S. Pat. No. 6,910,843 B2 issued to Tomberg on Jun. 28, 2005 and entitled TURBINE BUCKET AIRFOIL COOLING HOLE LOCATION, STYLE AND CONFIGURATION discloses a large turbine blade (also referred to as a bucket) with radial cooling holes drilled into the blade.

U.S. Pat. No. 6,164,913 issued to Reddy on Dec. 26, 2000 and entitled DUST RESISTANT AIRFOIL COOLING shows a turbine airfoil with an internal cooling circuit having a triple-pass (3-pass) serpentine cooling circuit with a first leg adjacent to the airfoil leading edge, a second leg at mid-blade, and the third leg near the trailing edge and connected to exit holes on the trailing edge by metering holes. The 3-pass serpentine flow cooling circuit provides better cooling than the single pass straight radial holes of the Tomberg patent using the same amount of cooling flow because of the serpentine path through the blade.

It is an object of the present invention to provide for a cooling circuit within a large highly tapered blade.

It is another object of the present invention to provide a ceramic core assembly than can be used for casting a large highly tapered blade with a serpentine flow cooling circuit within the blade.

BRIEF SUMMARY OF THE INVENTION

The present invention is a large highly twisted turbine blade that includes a serpentine flow cooling circuit formed within the blade. The blade normally includes a large cross sectional area at the blade lower span height and tapered to a small blade thickness at the upper blade span height. The blade includes a three-pass (or triple pass) serpentine flow cooling circuit with a first leg located adjacent to the leading edge, and the third leg extending along the entire blade near to the trailing edge. The trailing edge includes a lower cooling channel extending from the root to a point about midway to the tip. The trailing edge also includes an upper impingement cooling channel extending from the end of the lower cooling channel to the blade tip. The upper channel is separated from the lower channel by a core tie with a metering hole in it. Cooling air is supplied to the lower cooling channel from an outside source to cool the lower portion of the trailing edge. Cooling air is supplied to the upper impingement cooling channel from the third leg of the serpentine flow cooling circuit through metering holes and then discharges out through exit holes to cool the upper trailing edge of the blade.

The blade is formed from four ceramic cores in which the first leg is formed from a first core, the second leg is formed from a second core, the third leg and the upper impingement channel is formed from a third core, and lower cooling channel is formed from a fourth core.

DETAILED DESCRIPTION OF THE INVENTION

Figure 1:
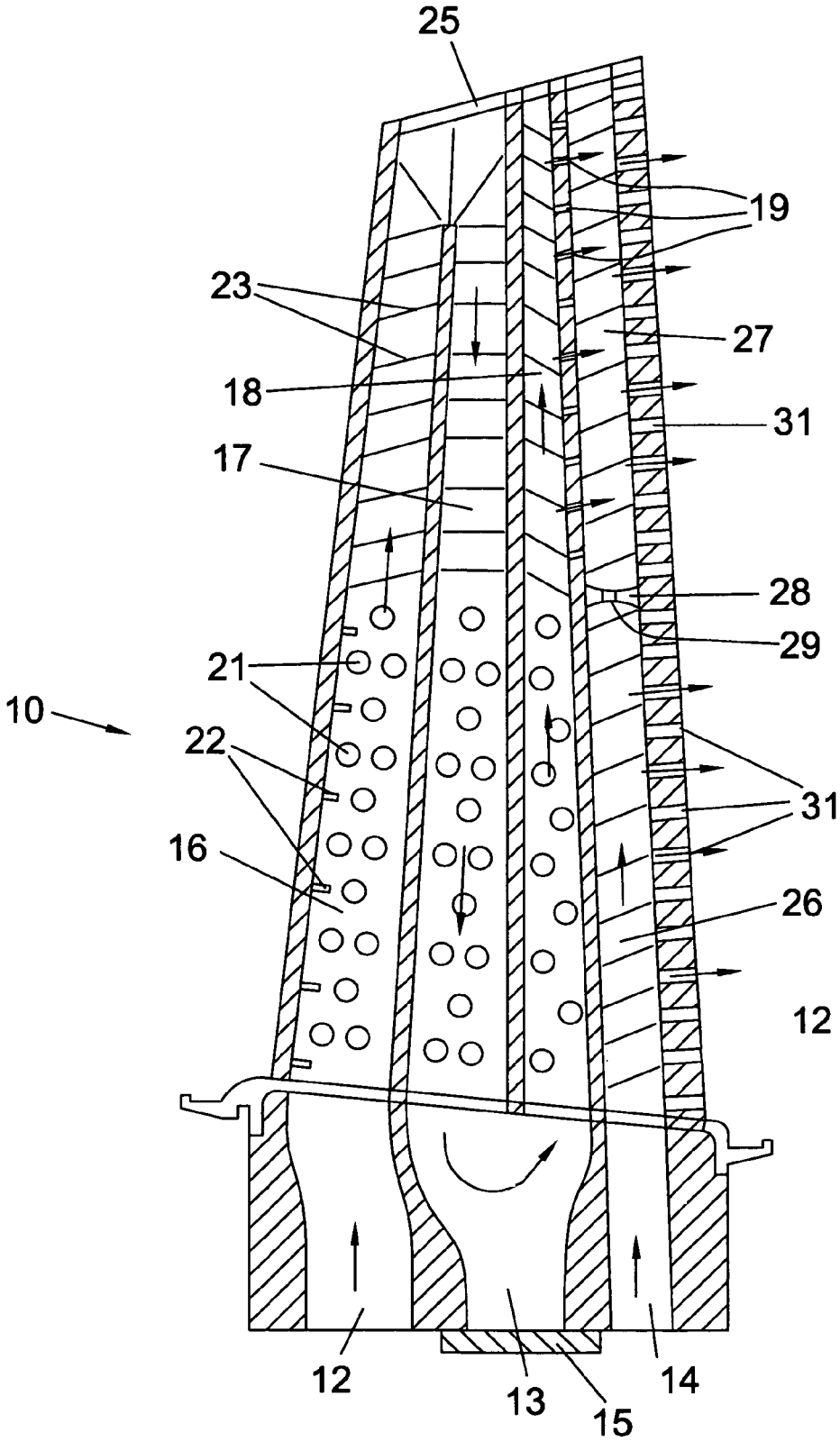
FIG. 1 shows a side view of the internal serpentine flow cooling circuit of a turbine blade of the present invention.
Figures 2A, 2B, 2C, 2D:
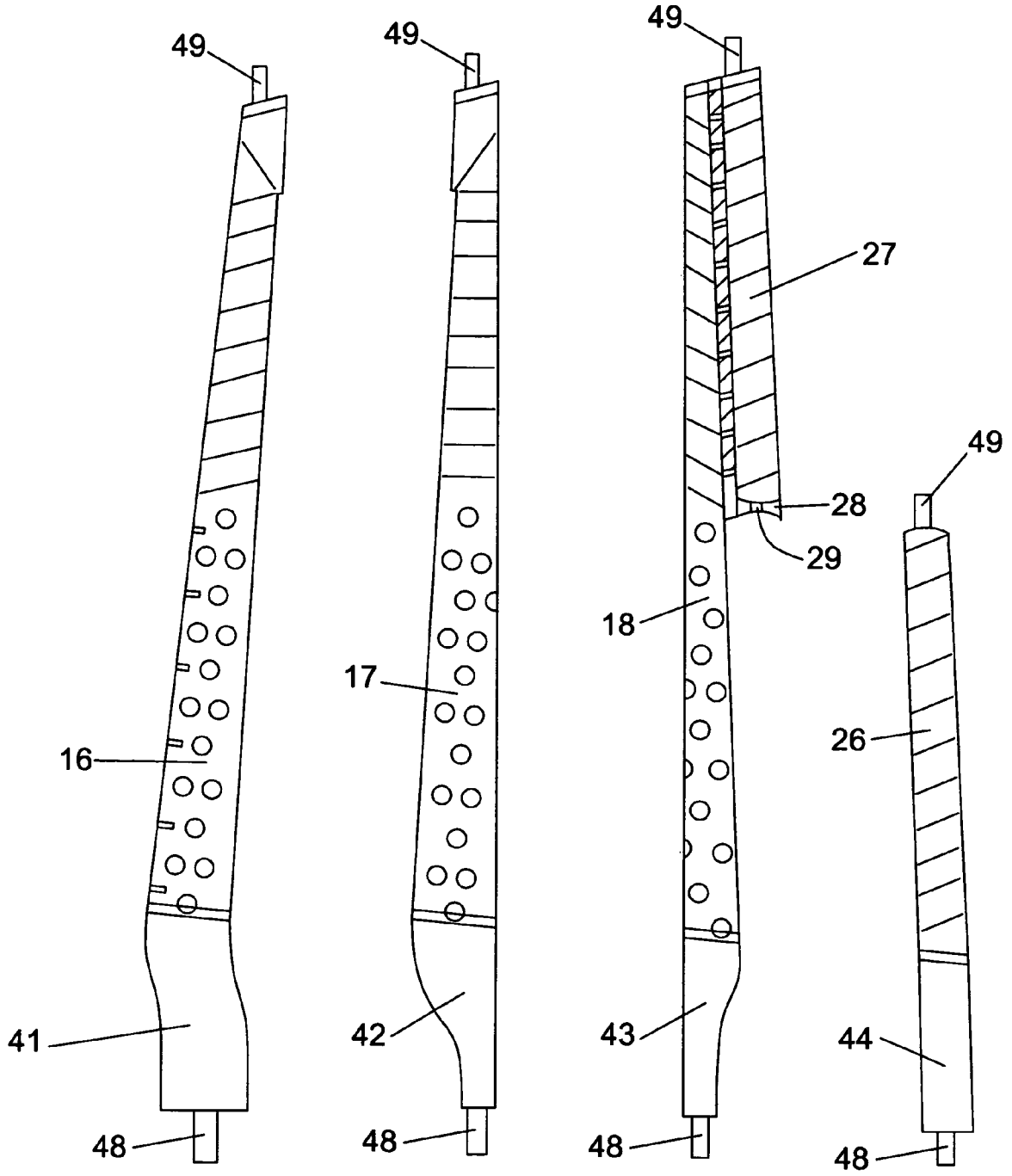
FIG. 2 shows a side view of the four ceramic cores that are used to cast the turbine blade with the serpentine flow cooling circuit of the blade in FIG. 1.

The turbine blade of the present invention is shown in FIG. 1. The blade 10 includes a root portion with cooling supply passages 12-14 formed therein, an airfoil portion extending from the root and having a leading edge and trailing edge and a pressure side and suction side, and a tip 25. the blade includes a cooling air supply passage 12 leading into a first leg 16 of a serpentine flow cooling circuit, a second leg 17 opening into a closed passage 13 within the root, and a third leg 18 extending to the blade tip 25. The lower span of the three legs of the serpentine flow cooling circuit have pin fins 21 for the reduction of cooling flow cross sectional area which increases the cooling through velocity. This subsequently increases the cooling side internal heat transfer coefficient. A cover plate 15 closes off the closed passage 13.

The upper span of the blade includes trip strips 23 in the three legs of the serpentine passage. Because the upper span of the blade is very thin, using pin fins in the ceramic core may reduce the casting yields and therefore, the trip strips are used in the upper span for augmenting the internal heat transfer capability. Pin banks are used at the blade lower span for the reduction of cooling flow cross sectional area and therefore increase the cooling through velocity and subsequently increase the cooling side internal heat transfer coefficient. Since the blade upper span geometry is very thin, incorporating pin fins in the ceramic core may reduce the casting yields and therefore trip strips are incorporated at the blade higher span for augmenting the internal heat transfer capability.

The trailing edge of the blade includes a plurality of exit holes 31 spaced along the trailing edge to discharge cooling air. A trailing edge cooling supply passage 14 is formed in the root and delivers cooling air into a lower cooling channel 26 that extends up to a point about mid-height to the tip 25. A core tie 28 encloses the lower cooling channel 26 and includes a hole 29 to mate with a print out of a ceramic core described below. The trailing edge also includes an upper impingement cooling channel 27 formed along the trailing edge from the core tie 28 to the blade tip 25. The upper impingement channel 27 is fluidly connected to the third leg 18 of the serpentine circuit through impingement holes 19 spaced along the rib separating the two cooling passages. The upper impingement channel 27 also includes exit holes 31 to discharge cooling air. The lower cooling channel 26 and the upper impingement cooling channel 27 includes trip strips 23 spaced along the channels to promote turbulent flow within the cooling air and improve the heat transfer property. The hole 29 in the core tie 28 also allows for cooling air to pass through from the lower span channel 26 into the upper span impingement channel 27.

The operation of the blade with the cooling passage is as follows. Cooling air is supplied from an outside source to the cooling supply passage 12 and flows through the first leg 16, passing over the pin fins 21 in the lower span and over the trip strips 23 in the upper span. The cooling air then is redirected 180 degrees at the tip 25 into the second leg 17 and passes over the trip strips 23 and pin fins 21 in the passage. The cooling air then is redirected 180 degrees in the closed passage 13, and flows into the third leg 18, passing over the pin fins in the lower span and the trip strips in the upper span. The cooling air flowing in the upper span of the third leg 18 is gradually metered through a series of impingement holes 19 spaced along the upper span. Cooling air passing through the impingement holes 19 passes into the upper impingement channel 27 to provide impingement cooling of the upper span trailing edge portion of the blade. The cooling air exits through the exit holes 31 in the upper span to provide cooling thereof.

Cooling air from the source is also supplied to the trailing edge cooling supply passage 14 and passes into the lower cooling channel 26, and then flows out the exit holes 31 spaced along the trailing edge of the lower span for cooling thereof and into the upper span impingement channel 27 through the hole 29 in the core tie 28.

In the triple or three-pass serpentine flow cooling circuit of the present invention, an open root turn is formed in the serpentine cooling design. The elimination of the prior art root turn geometry eliminates the constraint to the cooling flow during the turn, which allows the cooling air to form a free stream tube at the blade root turn region. In addition to the aerodynamic root turn design benefit, the open serpentine flow root turn also greatly improves the serpentine ceramic core support to achieve a better casting yield and allow the second leg of the serpentine ceramic core to mate with a large third piece of ceramic core for the completion of the serpentine flow circuit. The triple pass serpentine flow is finally discharged into an impingement cavity located at the blade upper span prior to discharging through the airfoil trailing edge by a row of metering holes. Since the cooling air may be too warm for the large blade root section metal temperature requirement, a separated feed channel is included for the trailing edge lower span region to provide cooling air for the airfoil trailing edge root section. Cooling air is fed into the radial channel prior to being discharged through the airfoil trailing edge by a row of metering holes.

For the construction of a large twisted and tapered serpentine cooling flow geometry, individual ceramic cores for each of the flow channels is injected by itself. FIGS. 2*a* through 2*d* show the four ceramic cores. The first leg 16 is formed from a first ceramic core 41 that has standard print outs 48 and 49 formed on the ends. The second leg 17 is formed from a second core 42, the third leg 18 and upper impingement channel 27 is formed from a third core 43, and the lower channel 26 is formed from a fourth core 44. These four pieces of ceramic cores are then assembled together in a wax die prior to the injection of wax. The third core includes a core tie 28 with a hole 29 formed therein to accept the print out 49 of the fourth core 44 to form the completed trailing edge portion of the blade. The four individual ceramic cores 41-44 are assembled together in a wax die prior to injection of the wax.

In the triple pass serpentine cooling design of the present invention, an open root turn is incorporated in the serpentine cooling design. The elimination of traditional root turn geometry thus eliminates the constraint to the cooling flow during the turn which allows the cooling air to form a free stream tube at the blade root turn region. In addition to the aerodynamic root turn design benefit, the open serpentine root turn also greatly improves the serpentine ceramic core to mate with a large $3^{rd}$ piece of ceramic core for the completion of the serpentine flow circuit.

The present invention provides several advantages over the known prior art. Some include the elimination of serpentine root turn geometry which improves the casting yield for any serpentine cooled blade design and allows for mating of large, second and third legs of ceramic cores. Aerodynamic root turn concept improves serpentine turn loss and increases available blade working pressure for achieving better blade cooling efficiency. The triple pass serpentine cooling concept yields a lower and more uniform blade sectional mass average temperature which improves blade creep life capability. The dedicated trailing edge radial cooling circuit provides cooler cooling air for the blade root section and therefore improves airfoil high cycle fatigue (HCF) capability. The current cooling concept provides cooling for the airfoil thin section and therefore improves the airfoil oxidation capability and allows for a higher operating temperature for future engine upgrade.

I claim the following:

1. A large turbine blade comprising:

a serpentine flow cooling circuit with a first leg adjacent to a leading edge of the blade;

a second leg of the serpentine flow cooling circuit located adjacent to and downstream from the first leg;

a last leg of the serpentine flow cooling circuit located near a trailing edge of the blade;

an impingement cooling channel located on an upper span of the trailing edge of the blade, the impingement cooling channel having a first plurality of exit holes spaced along the upper span of the trailing edge of the blade;

a cooling supply channel located on a lower span of the trailing edge of the blade, the cooling supply channel having a second plurality of exit holes spaced along the lower span of the trailing edge of the blade;

a first cooling air supply passage in a root of the blade to supply cooling air to the first leg of the serpentine flow cooling circuit;

a second cooling supply channel in the root of the blade to supply cooling air to the cooling supply channel; and, a plurality of impingement holes to provide fluid communication between the last leg of the serpentine flow cooling circuit and the impingement cooling channel.

2. The large turbine blade of claim 1, and further comprising:

the upper span impingement cooling channel is in fluid communication with the lower span cooling supply channel through a hole in a core tie separating the lower span channel from the upper span channel.

3. The large turbine blade of claim 1, and further comprising:

the last leg of the serpentine flow cooling circuit is a third leg.

4. The large turbine blade of claim 1, and further comprising:

the lower span of the serpentine flow cooling circuit includes pin fins; and, the upper span of the serpentine flow cooling circuit includes trip strips.

5. The large turbine blade of claim 2, and further comprising:

the core tie is positioned about midway along the trailing edge of the blade having the cooling exit holes therein.

6. The large turbine blade of claim 1, and further comprising:

the impingement cooling channel in the upper span and the cooling supply channel located on a lower span of the trailing edge of the blade both include trip strips to promote turbulent flow within the cooling air.

7. The large turbine blade of claim 1, and further comprising:

all of the cooling air passing through the last leg of the serpentine cooling flow circuit is discharged into the impingement cooling channel.

8. The large turbine blade of claim 1, and further comprising:

the plurality of impingement holes are spaced along the impingement cooling channel from substantially the bottom of the channel to the top of the channel.

9. A process for cooling a large turbine blade, the turbine blade having a trailing edge with a plurality of upper span and lower span exit holes spaced from a root to a blade tip, the process comprising the steps of:

passing a first cooling air through a serpentine flow cooling circuit in which the first leg is adjacent to the leading edge of the blade;

passing a second cooling air through a cooling channel in a lower span of the trailing edge of the blade;

passing the first cooling air from the last leg of the serpentine flow cooling circuit through a plurality of impingement holes into an impingement cooling channel located on the upper span of the trailing edge of the blade;

discharging the first cooling air from the upper span through a plurality of upper span exit holes spaced along the trailing edge upper span; and, discharging the second cooling air from the lower span through a plurality of lower span exit holes spaced along the trailing edge lower span.

10. The process for cooling a large turbine blade of claim 9, and further comprising the step of:

passing some of the cooling air in the lower span channel into the upper span impingement channel.

11. The process for cooling a large turbine blade of claim 9, and further comprising the step of:

promoting turbulent flow within the lower span of the serpentine flow cooling circuit with pin fins.

12. The process for cooling a large turbine blade of claim 9, and further comprising the step of:

promoting turbulent flow within the upper span of the serpentine flow cooling circuit with trip strips.

13. The process for cooling a large turbine blade of claim 11, and further comprising the step of:

promoting turbulent flow within the upper span of the serpentine flow cooling circuit with trip strips.

14. The process for cooling a large turbine blade of claim 9, and further comprising the step of:

promoting turbulent flow within the cooling channel in a lower span and the impingement cooling channel on the upper span with trip strips.

15. The process for cooling a large turbine blade of claim 9, and further comprising the step of:

separating the cooling channel in a lower span from the impingement cooling channel on the upper span with a core tie located at about the blade midpoint from the platform to the tip.

16. A core assembly used for casting a large turbine blade, the turbine blade having a serpentine flow cooling circuit and a trailing edge with a plurality of exit cooling holes extending along the edge, the core assembly comprising:

a first core used to form the first leg of the serpentine flow circuit along the leading edge of the blade;

a second core used to form the second leg of the serpentine flow circuit;

a third core used to form a last leg of the serpentine flow circuit, the third core having a upper span impingement cavity forming piece with trailing edge exit holes and a core tie on the bottom portion of the upper span, the core tie having a hole sized to receive a print out; and, a fourth core used to form a lower cooling channel, the fourth core having trailing edge exit holes and a printout extending from the top and sized to fit within the hole in the core tie of the third core, whereby the third and fourth cores form the trailing edge of the blade with cooling exit holes extending along the trailing edge.

17. The core assembly of claim 16, and further comprising:

the third core and the fourth core form separate cooling air supply passages with a cooling air hole connecting the cores.

18. The core assembly of claim 16, and further comprising:

each core includes printouts to secure the cores within a mold cavity.

19. The core assembly of claim 16, and further comprising:

the first, second and third cores include pin fin forming members on the lower span and trip strip forming members of the upper span.

20. The core assembly of claim 16, and further comprising:

the impingement cavity on the third core and the fourth core include trip strip forming members.

* * * * *